US009273836B2

(12) United States Patent
Chang

(10) Patent No.: US 9,273,836 B2
(45) Date of Patent: Mar. 1, 2016

(54) MEDICAL/DENTAL HEADLIGHT SYSTEM WITH INTERCHANGEABLE BEAM-FORMING OPTICS

(75) Inventor: Byung J. Chang, Ann Arbor, MI (US)

(73) Assignee: General Scientific Corporation, Ann Arbor, MI (US)

( * ) Notice: Subject to any disclaimer, the term of this patent is extended or adjusted under 35 U.S.C. 154(b) by 1799 days.

(21) Appl. No.: 12/512,644

(22) Filed: Jul. 30, 2009

(65) Prior Publication Data

US 2011/0026258 A1 Feb. 3, 2011

(51) Int. Cl.

| | |
|---|---|
| ***F21V 17/04*** | (2006.01) |
| ***F21S 8/00*** | (2006.01) |
| ***F21L 14/00*** | (2006.01) |
| ***F21V 17/12*** | (2006.01) |
| *F21W 131/202* | (2006.01) |
| *F21W 131/205* | (2006.01) |
| *F21Y 101/02* | (2006.01) |

(52) U.S. Cl.

CPC ..... *F21L 14/00* (2013.01); *F21V 17/12* (2013.01); *F21W 2131/202* (2013.01); *F21W 2131/205* (2013.01); *F21Y 2101/02* (2013.01)

(58) Field of Classification Search

CPC ... F21L 14/00; F21V 17/12; F21W 2131/202; F21W 2131/205; F21Y 2101/02

USPC ..... 362/105, 164, 169, 257, 277, 268, 362/281–283, 311.01, 311.06, 319, 804

See application file for complete search history.

(56) References Cited

U.S. PATENT DOCUMENTS

| | | | | |
|---|---|---|---|---|
| 3,278,738 | A * | 10/1966 | Clark | 362/552 |
| 3,830,230 | A * | 8/1974 | Chester | 600/249 |
| 5,430,620 | A * | 7/1995 | Li et al. | 362/572 |
| 7,581,852 | B2 * | 9/2009 | Kennedy et al. | 362/253 |
| 2006/0098440 | A1 * | 5/2006 | Allen | 362/294 |

* cited by examiner

*Primary Examiner* — Stephen F Husar

(74) *Attorney, Agent, or Firm* — Dinsmore & Shohl LLP

(57) ABSTRACT

A head-mounted light source particularly suited to medical and dental applications includes a base unit with a source of illumination directed through a distal opening in the base unit, and a plurality of interchangeable beam-forming units, each separately attachable to the distal opening of the base unit to produce a different light spot size at a given distance. The preferred embodiment includes a wide-field beam-forming unit, an intermediate beam-forming unit and a high-intensity beam-forming unit, such that the diameter of the spot size progressively decreases from the wide-field to the intermediate to the high-intensity unit. The interchangeable beam-forming units are attached to the base unit through a threaded connection. Each interchangeable beam-forming unit may itself include a distal threaded connection for attachment of a UV or other filter. In the preferred embodiment, the base unit includes a clip adapted for attachment to an ocular mounting assembly.

6 Claims, 1 Drawing Sheet

MEDICAL/DENTAL HEADLIGHT SYSTEM WITH INTERCHANGEABLE BEAM-FORMING OPTICS

FIELD OF THE INVENTION

This invention relates generally to head-mounted lights of the type used by medical and dental professionals and, in particular, to a headlamp system with interchangeable beam-forming optics.

BACKGROUND OF THE INVENTION

Many medical and dental professionals use head-mounted lights to better visualize procedures. However, different spot sizes and/or light intensities are preferred for different situations. For example, whereas a wide-angle spot may be suitable for lower magnification and large surgical fields, a more narrow, high-intensity beam may be desired for procedures that require the brightest light. In many instances, the spot size is matched to the magnification or field of view associated with telemicroscopic loupes worn by the same user. Currently, however, to change spot size, purchasers need to buy different head-mounted units, raising overall cost.

SUMMARY OF THE INVENTION

The present invention is directed to a light source particularly suited to medical and dental applications. The system includes a base unit including a source of illumination directed through a distal opening in the base unit, and a plurality of interchangeable beam-forming units, each separately attachable to the distal opening of the base unit to produce a different light spot size at a given distance.

The preferred embodiment includes a wide-field beam-forming unit, an intermediate beam-forming unit and a high-intensity beam-forming unit, such that The diameter of the spot size progressively decreases from the wide-field to the intermediate to the high-intensity unit. In particular, the diameter of the spot size may progressively decrease from about 6 inches for the wide-field unit to about 4 inches for the intermediate to about 2 inches for the high-intensity unit.

The interchangeable beam-forming units are attached to the base unit through a threaded connection. Each interchangeable beam-forming unit may itself include a distal threaded connection for attachment of a UV or other filter. In the preferred embodiment, the base unit includes a clip adapted for attachment to an ocular mounting assembly.

DETAILED DESCRIPTION OF THE INVENTION

Figure 1:
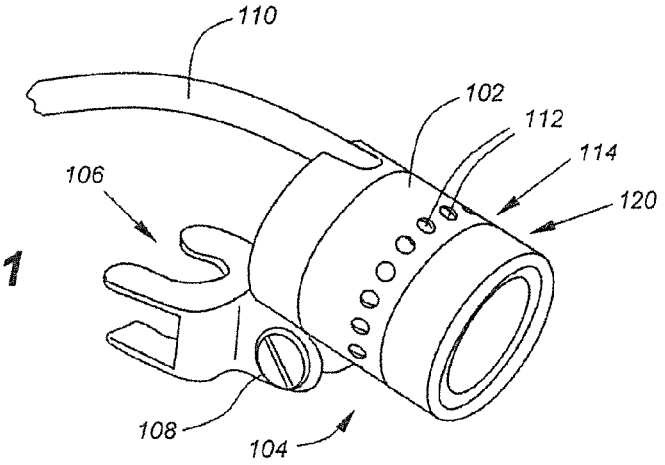
FIG. 1 is a drawing that shows a medical/dental light according to the invention with a wide-angle, screw-on beam-forming optics.

This invention resides in a versatile light source assembly particularly suited to medical and dental professionals. Referring to FIG. 1, the system includes a base unit 102 having a distal end 104 to which one of several beam-forming optical units may be attached. The base unit 102 is preferably coupled to a clip unit 106 through a swivel 108 enabling the assembly to be removable mounted to optical loupes of the type offered by Surgitel Products of Ann Arbor, Mich.

Different light sources may be disposed in the base unit 102. In the preferred embodiment, a multi-Watt light-emitting diode is used, in which case cord 110 provides electrical power from a remote power supply (not shown). Alternatively, cord 110 may be a fiber bundle providing light from a remote light source. The base unit 102 is preferably aluminum or other metal, with holes 112 being provided for more efficient cooling.

Figure 2:
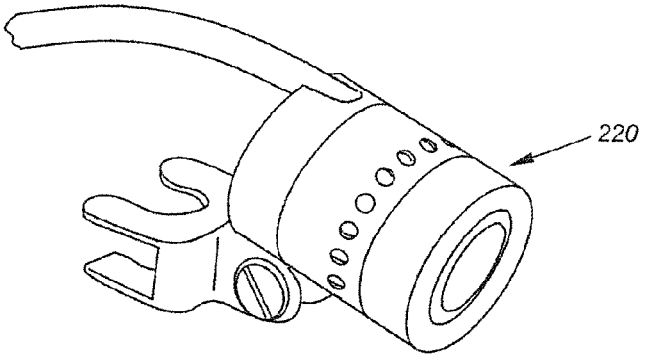
FIG. 2 shows the light of FIG. 1 with the optics interchanged for an intermediate spot size.
Figure 3:
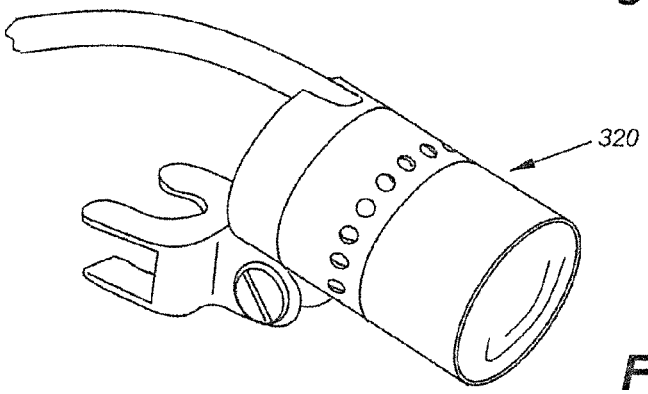
FIG. 3 shows the light of FIG. 1 with the optics interchanged for a narrow, more intense spot size.

The preferred embodiment includes three interchangeable beam-forming light units. These interchangeable units include a wide-field unit 120 FIG. 1), a standard field unit 220 (FIG. 2) and a high-intensity unit 320 (FIG. 3). The interchangeable beam-forming light units 120, 220, 320 are preferably interchanges through a threaded connection 114 at the distal end 104 of the base unit 102, though other connection mechanisms such as bayonet may alternatively be used. Each interchangeable beam-forming unit may itself include a distal threaded connection for attachment of a UV or other filter.

Although different optical configurations are possible, including customer-specific required beam spot sizes, in the preferred embodiment, the wide-field unit 120 provides a spot size on the order of 6" (15 cm) and a brightness of up to 3,000 ft-can (30,000 lux). The standard field unit 220 provides a spot size on the order of 4" (10 cm) and a brightness of up to 3,500 ft-can (35,000 lux). The high-intensity unit 320 provides a spot size on the order of 2" (7 cm) and a brightness of up to 7,500 ft-can (75,000 lux). Color temperature of 5,500K is the same in each case, with spot size and brightness being measured @ 16" (40 cm) from the eye. Any appropriate optical configurations may be supported in the base unit 102, including single lenses, multiple lenses, doublets and Fresnel lenses, so long as wide-field, standard, and high-intensity beam-forming optics are achieved.

With multiple beam-forming light optic units, the user has a choice whether to have a beam spot dispersed over a wide field for lower magnification and large surgical fields (for example), a standard unit for dental work (for example) or a high-intensity unit which may match with prism telescopes for procedures that require the brightest light.

I claim:

1. A light particularly suited to medical and dental applications, comprising:

a base unit including a source of illumination directed through a distal opening in the base unit;

a plurality of interchangeable beam-forming units, each separately attachable to the distal opening of the base unit to produce a different light spot size at a given distance; and wherein the base unit includes a clip adapted for attachment to an ocular mounting assembly.

2. The light of claim 1, including:

a wide-field beam-forming unit, an intermediate beam-forming unit and a high-intensity beam-forming unit; and wherein the diameter of the spot size progressively decreases from the wide-field to the intermediate to the high-intensity unit.

3. The light of claim 1, including:

a wide-field beam-forming unit, an intermediate beam-forming unit and a high-intensity beam-forming unit; and wherein the diameter of the spot size progressively decreases from about 6 inches for the wide-field unit to about 4 inches for the intermediate to about 2 inches for the high-intensity unit.

4. The light of claim 1, wherein the interchangeable beam-forming units are attached to the base unit through a threaded connection.

5. The light source of claim 1, wherein the light source is a multi-Watt LED interconnected to a remote source of electrical power.

6. The light source of claim 1, wherein the light source is remote from the base unit and interconnected thereto via a fiber-optic bundle.

* * * * *